US006813780B2

(12) United States Patent
Morrow

(10) Patent No.: US 6,813,780 B2
(45) Date of Patent: Nov. 9, 2004

(54) PADDED SPORTS GLOVE HAVING IMPROVED FLEXIBILTY AND BREATHABILITY

(76) Inventor: David Morrow, 28454 Wellington, Farmington Hills, MI (US) 48334

( * ) Notice: Subject to any disclaimer, the term of this patent is extended or adjusted under 35 U.S.C. 154(b) by 0 days.

(21) Appl. No.: 10/341,222

(22) Filed: Jan. 13, 2003

(65) Prior Publication Data

US 2003/0101504 A1 Jun. 5, 2003

Related U.S. Application Data

(63) Continuation of application No. 09/569,778, filed on May 12, 2000, now Pat. No. 6,550,069.

(51) Int. Cl.[7] ..... A41D 19/00
(52) U.S. Cl. ..... 2/161.1
(58) Field of Search ..... 2/16, 161.1, 161.3, 2/161.4, 161.6, 161.2, 167, 169, 20

(56) References Cited

U.S. PATENT DOCUMENTS 3,605,117 A * 9/1971 Latina ..... 2/16
4,484,359 A * 11/1984 Tirinen ..... 2/20
4,815,147 A * 3/1989 Gazzano et al. ..... 2/161.1
5,511,243 A * 4/1996 Hall et al. ..... 2/16
5,946,720 A * 9/1999 Sauriol ..... 2/16
6,122,769 A * 9/2000 Wilder et al. ..... 2/16
6,550,069 B1 * 4/2003 Morrow ..... 2/161.1

* cited by examiner

*Primary Examiner*—Katherine Moran
(74) *Attorney, Agent, or Firm*—Artz & Artz, PC

(57) ABSTRACT

A protective sports glove for the game of lacrosse having a cuff portion, a hand portion, a plurality of finger portions, and a thumb portion. The hand portion has a palm portion and a back portion. The back portion has a plurality of protective padded portions disposed thereon. A wrist guard is elastically coupled to the hand portion. A plurality of vent openings are formed in the back portion of the hand portion. A plurality of mesh portions are disposed on the palm portion in areas that are not intended to provide primary contact with a stick.

58 Claims, 4 Drawing Sheets

PADDED SPORTS GLOVE HAVING IMPROVED FLEXIBILTY AND BREATHABILITY

CROSS-REFERENCE TO RELATED APPLICATIONS

This is a continuation of U.S. patent application Ser. No. 09/569,778 filed on May 12, 2000, now U.S. Pat. No. 6,550,069.

TECHNICAL FIELD

The present invention relates generally to a protective sports glove. More specifically, the present invention relates to a protective sports glove for use in the game of lacrosse that provides improved protection to a user's hand, while providing improved flexibility, durability, fit and breathability.

BACKGROUND ART

In contact sports, such as lacrosse or hockey, where sticks are essential elements of the game, a player's hands and wrists are especially vulnerable to injury when being checked by another player's stick. For this reason, players typically utilize padded gloves to protect their hands, wrists and lower forearms during play. The areas of a player's hand that are particularly susceptible to injury are those where the glove flexes, because at those locations, the protective padding is typically constructed such that it can bend or flex with a player's joint. However, such bending or flexing, such as at the wrist or knuckle area, can leave the player's joint exposed due to the bending away of the protective padding and, therefore, susceptible to injury.

Accordingly, wrist guards are known in the art for protective sports gloves to provide protection for a player's wrist between the cuff and hand portion. While most prior wrist guards provide adequate protection, they provide limited flexibility and adjustability and are therefore uncomfortable and are often removed by user. It is also a problem to provide a protective guard for a player's wrist between the glove and cuff portion that both protects the user's wrist, also provides flexibility and is not overly bulky.

Additionally, most prior gloves disclose cuffs that are secured directly to the glove portion by stitching. The stitching limits the flexibility of a player's wrist and also cannot be adjusted. U.S. Pat. No. 5,983,396, discloses a configuration where the cuff and glove portion are attached to one another by lacing which allows for improved flexibility and also adjustability. However, the lacing typically must be done by hand and therefore requires significant labor time in order to manufacture the glove, thereby increasing its cost.

Further, many prior gloves attempt to provide limited breathability and flexibility. Therefore, certain gloves have been introduced that utilize mesh material on portions of a player's palm and fingers. However, the mesh material is located in primary areas that contact a stick and because of the amount of movement of the stick in a player's hand, such as through cradling or the like, the mesh material tends to wear quickly and ultimately tear, therefore making the glove illegal. Moreover, some prior gloves have utilized vent holes in the glove to provide ventilation. The vent holes in these prior gloves, however, are relatively small and therefore offer little ventilation. Further, prior gloves that have tried to provide improved breathability through the inclusion of vent holes have done so at the expense of exposing a user's hand to injury at that location.

SUMMARY OF THE PRESENT INVENTION

It is therefore an object of the present invention to provide a protective sports glove for utilization in contact stick sports, such as lacrosse and hockey, having a wrist guard that is coupled to the glove so as to provide maximum protection and flexibility.

It is a further object of the present invention to provide a protective sports glove for utilization in contact stick sports, such as lacrosse and hockey, that is more flexible and therefore more comfortable for a player.

It is still another object of the present invention to provide a protective sports glove for utilization in contact stick sports, such as lacrosse and hockey, that provides more breathability and ventilation than prior gloves without sacrificing durability or protection.

It is yet another object of the present invention to provide a protective sports glove for use in lacrosse that is smaller than prior gloves.

It is still a further object of the present invention to provide a protective sports glove for use in lacrosse that provides a better fit for a user's hand.

In accordance with the above and other objects of the present invention, an improved protective sports glove is provided. The sports glove has a cuff portion for engaging a user's wrist and forearm and a hand portion elastically coupled to the cuff portion. The hand portion has a palm portion on the inner side of the glove and an opposing portion. The glove has a plurality of finger portions extending from the hand portion for receipt of a user's fingers therein and a thumb portion. A wrist guard is secured to the cuff portion and elastically coupled to the hand portion. The back portion of the hand portion has a plurality of protective padded portions. The protective padded portions are cut horizontally to allow a user's hand to flex and also vertically to conform to a user's hand as it holds the stick. At least one vent opening is formed between two protective padded portions disposed on either side of the vertical cut in the back portion. The palm portion of the glove is similarly comprised of a non-mesh material with a plurality of mesh portions, whereby the mesh material is located in the palm portions in areas that are not intended to have primary contact with the handle of a stick and thus will not wear.

These and other features of the present invention will become apparent from the following description of the invention, when viewed in accordance with the accompanying drawings and appended claims.

DETAILED DESCRIPTION OF THE PREFERRED EMBODIMENT

Figure 1:
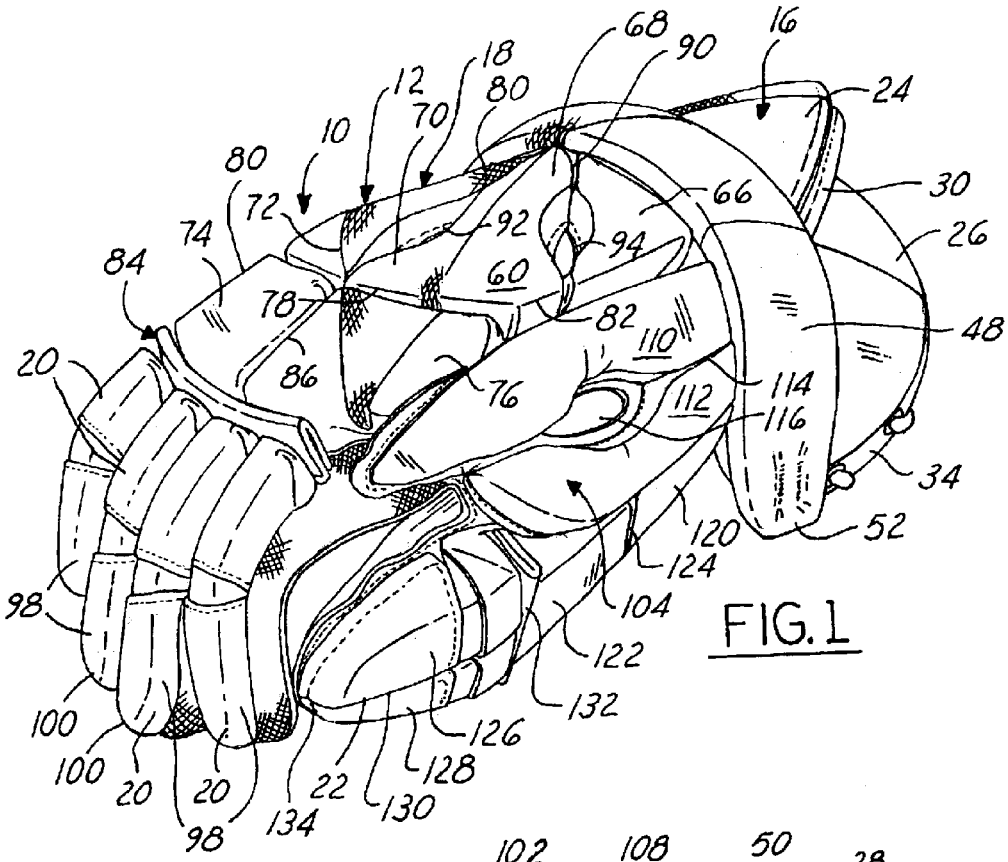
FIG. 1 is a perspective view of a protective sports glove in accordance with a preferred embodiment of the present invention.
Figure 2:
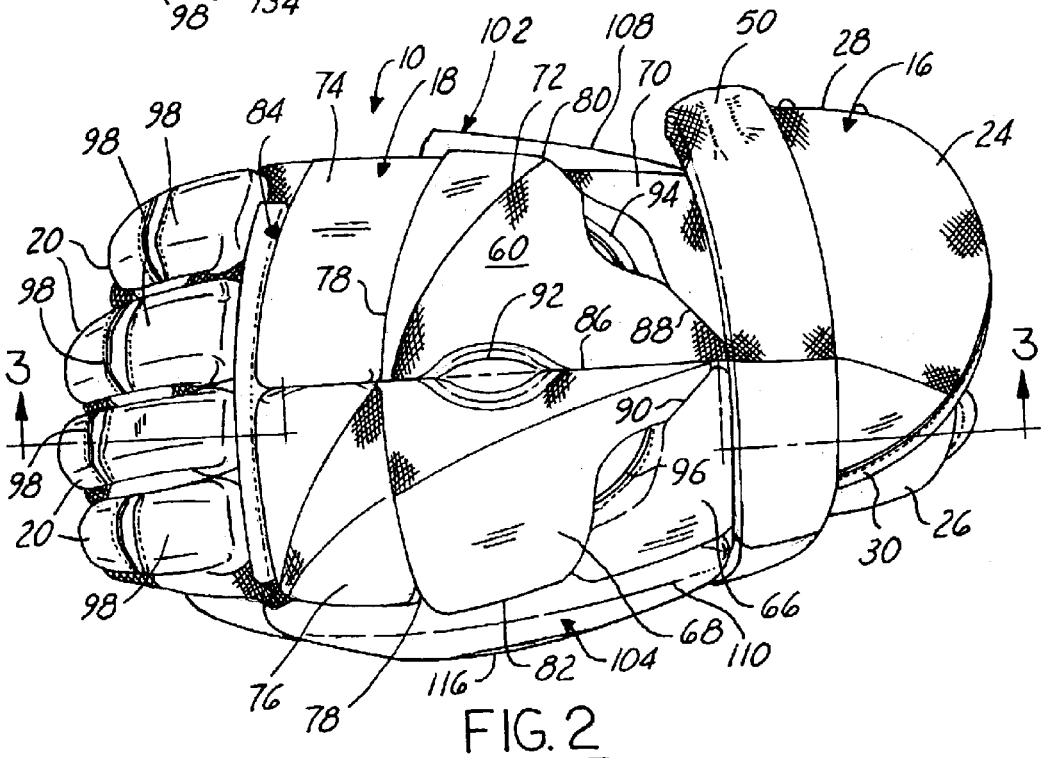
FIG. 2 is a top view of a protective sports glove in accordance with a preferred embodiment of the present invention.
Figure 3:
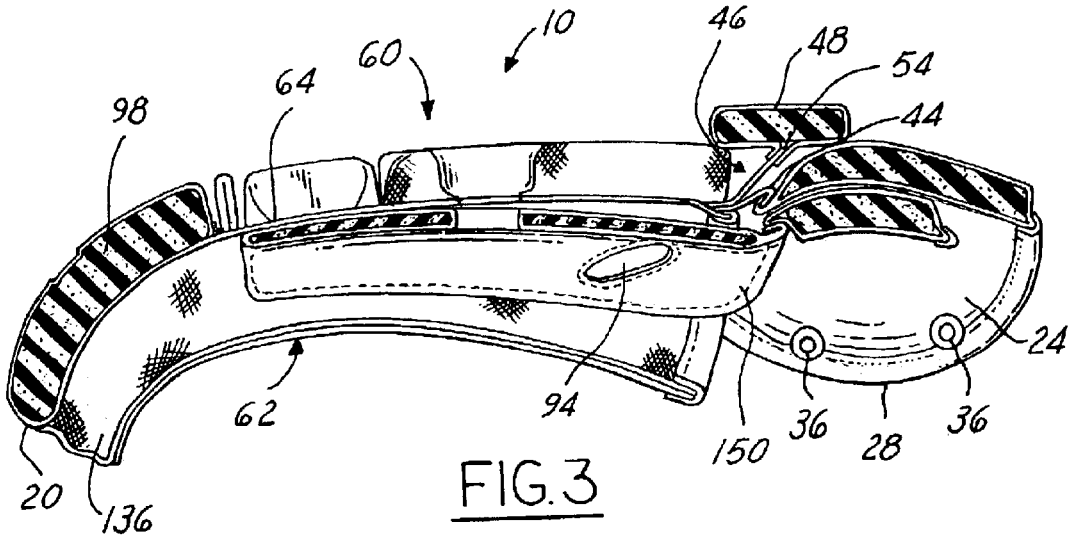
FIG. 3 is a cross-sectional view of the protective sports glove of FIG. 2 along the line 3—3.

Referring now to the Figures, which illustrate a lacrosse glove 10 in accordance with the present invention. The disclosed glove 10 is preferably for use in lacrosse, however, it should be understood that the disclosed glove 10 may be used in any other contact stick sport, including hockey. The glove 10 has a top portion 12 and a bottom portion 14 which therebetween define an interior space for receipt of a lacrosse player's hand. The glove 10 has a cuff portion 16, a hand portion 18 coupled to the cuff portion 16, a plurality of finger portions 20 extending from the hand portion 18 and a thumb portion 22 also extending from the hand portion 18.

Referring now to the FIGS. 1 through 4 and 6, the cuff portion 16 preferably has a first cuff portion 24 and an adjacent second cuff portion 26. The first cuff portion 24 and the second cuff portion 26 are secured at an upper border portion 27. The first cuff portion 24 has a first edge portion 28 and a second edge portion 30. The second cuff portion 26 has a first edge pardon 32 and a second edge portion 34. The second edge portion 30 of the first cuff portion 24 overlaps the first edge portion 32 of the second cuff portion 26 to provide a split cuff. The first cuff portion 24 and the second cuff portion 26 are designed to cover and protect substantial portions of a user's wrist and forearm. The overlapping (split cuff) configuration of the cuff portions 24, 26 provides added protection to a user's wrist and forearm because of the double layer of padding. Further, because the cuff portions 24, 26 are not affixed to each other along their adjacent edge portions 30, 32, they can move with respect to one another and therefore provide desired flexibility for a user's wrist as it moves during play.

The first edge portion edge 28 of the first cuff portion 24 preferably has a first set of eyelets 36 formed therein. Similarly, the second edge portion 34 of the second cuff portion 26 has a second set of eyelets 38 formed therein. A lace 40 or other securing device is preferably passed through the first and second set of eyelets 36, 38 to connect the first cuff portion 24 to the second cuff portion 26 and surround a user's forearm when a user's hand is located in the interior space. As shown, the lace 40 is intended to pass around the underside of a user's forearm such that the tightness of the cuff portions 24, 26 with respect to a user's forearm may be adjusted. The lace 40 may be maintained in its desired position at a desired tightness through the use of the cord lock 42 or other similar locking device.

Figure 6:
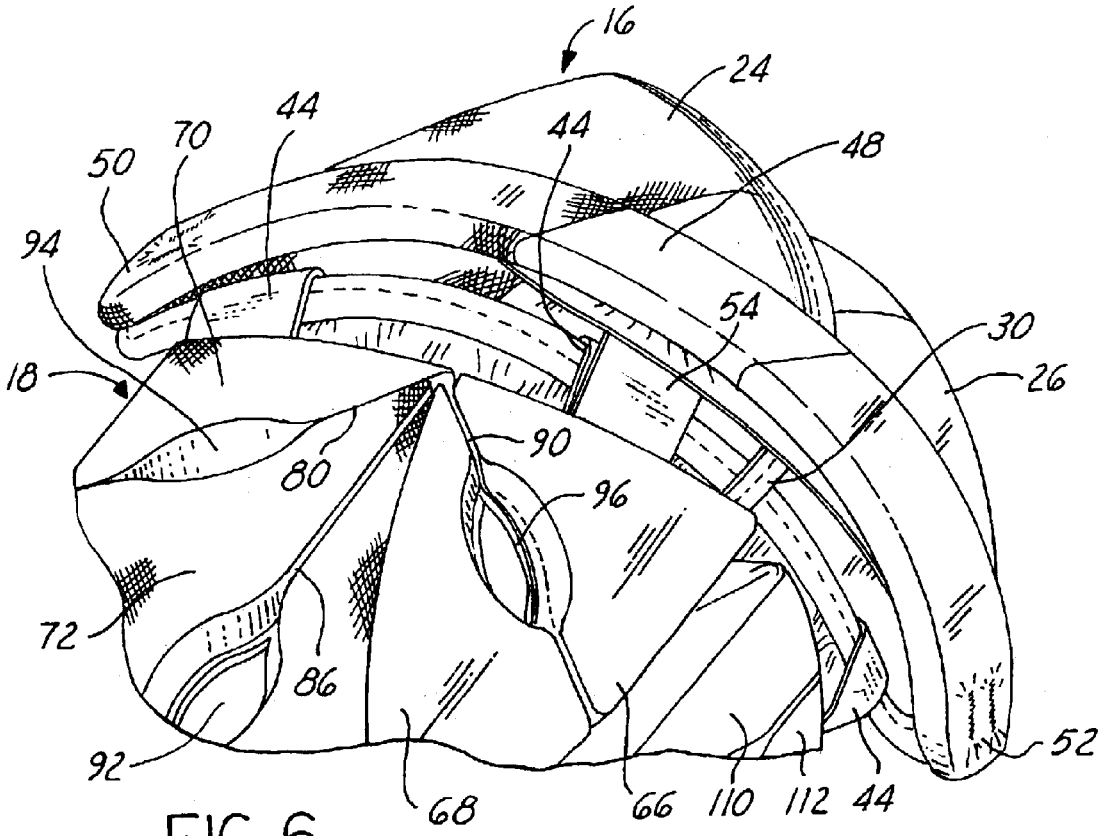
FIG. 6 is an enlarged view of the junction of the cuff portion to the glove portion, which illustrates the wrist guard in accordance with a preferred embodiment of the present invention.

As best shown in FIG. 6, the cuff portion 16 is preferably secured to the hand portion 18 through a plurality of elastic members 44. Each of the elastic members 44 is preferably secured at one end to the upper border 37 of the cuff portion 16 and at an opposing end to the hand portion 18. This configuration keeps the cuff portion 16 secured to the hand portion 18. However, the elastic members 44 allow the cuff portion 16 to move with respect to the hand portion 18 and provide flexibility as the user's hand flexes during play. The elastic members 44 are preferably disposed on either side of the cuff portion 16 with a third elastic member 44 being disposed generally in the middle. As the cuff portion 16 moves with respect to the hand portion 18, the back of a player's wrist or hand can be exposed at a seam 46 formed therebetween. Accordingly, a wrist guard 48 is preferably disposed over the seam 46 between the cuff portion 16 and the hand portion 18. The wrist guard 48 has a first end 50, which is preferably secured to the first cuff portion 24 adjacent the first edge portion 28. The wrist guard 48 has a second end 52 which is preferably attached to the second cuff portion 26 adjacent the second edge portion 34. While the first and second ends 50, 52 of the wrist guard 48 are preferably secured to the cuff portion 16 by sewing. It should be understood that the ends 50, 52 way be attached by any other known securing means. Alternatively, the wrist guard 48 could instead be secured to the hand portion 18. The integral attachment of the wrist guard 48 to the glove 10 prevents the wrist guard 48 from being removed and therefore provides permanent protection.

Additionally, the wrist guard 48 is preferably coupled to the hand portion 18 by an elastic member 54. The elastic member 54 allows the wrist guard 48 to flex or move as needed during movement by a user's hand during play and still remain over the seam 46. As shown, the wrist guard 48 is preferably located so that it lies over the seam 46 and above the top portion 12 of the glove 10. Alternatively, the wrist guard 48 may be disposed within the interior space of the glove 10 to cover the seam 46 from below the top portion 12.

The hand portion 18 extends between the seam 46 in the finger portions 20 and has a rear portion 60 and a palm portion 62. The rear portion 60 preferably has an inner fabric 64 having a plurality of protected padded portions 66 secured thereto. As shown, the rear portion 60 is preferably subdivided into individual protective padded portions 66, 68, 70, 72, 74, 76. The rear portion 60 of the glove 10 has a first lengthwise cut 78, i.e., from one side 80 of the hand portion 18 to the other side 82 of the hand portion 18, which allows the glove to flex along the lengthwise cut 78 as a user's hand moves. Specifically, the lengthwise cut 78 is cut so that the protective padded portions 74 and 76 are moveable with respect to the adjacent protective padded portions 68 and 72. The lengthwise cut 78 provides a glove flex line or seam that allows the glove to flex above the cut 78.

The protective padded portions 74, 76 terminate at a junction 84 between the hand portion 18 and the finger portions 20. The junction 84 allows the finger portions 20 to move with respect to the padded portions 74 and 76 as the junction 84 is generally disposed over a user's knuckle area, allowing the finger portions 20 to move as a user's fingers flex. Additionally, the rear portion 60 has a vertical cut 86 that extends generally from the cuff portion 16 to the junction 84. The vertical cut 86 allows the protective padded portions 68 and 76 to move with respect to the protective padded portions 72 and 74, allowing the glove to bend around an axis defined by the vertical cut 86. The vertical cut 86 allows the glove to fit more comfortably as it allows the glove to better conform to a user's hand as he closes his hand around a stick and, therefore, providing a tighter shape. This is necessary as the back of a typical user's hand is not flat, and the padded protected portions are not flexible enough to bend without the vertical cut portion 86. Thus, prior gloves tend to flatten out as a user flexes his hand which causes additional tension to be applied to the palm portions 62. The vertical cut 86 provides a glove flex line or seam that allows the glove to flex about the cut 86. The vertical cut, glove flex line or seam is formed in the middle of the hand portion 18 or equidistant between the respective sides of the hand portion 80 and 82.

The rear portion 60 of the hand portion 18 preferably has a pair of opposing angled cuts 88 and 90 which begin generally at the base of the hand portion 18 adjacent the seam 46 and extend generally outward to the respective side 80, 82 of the hand portion 18. The angled cuts 88, 90 similarly assist the glove 10 in conforming to the user's hand as the protective padded portions 66, 70 can each independently move with respect to the other padded portions as a user's hand flexes during play, thus providing a better fitting glove. The cuts 78, 84, 86, 88, and 90, are preferably formed in the glove through die cutting or other known cutting or forming means, which are sufficient to configure the rear portion 60 of the glove to conform to the configuration described above. The rear portion 60 may have a variety of additional or different cuts as desired.

The rear portion 60 of the hand portion 18 has a plurality of vent openings formed therein to provide ventilation to a user's hand. A first vent opening 92 is preferably disposed along the vertical cut 86 between the protective padded portion 68 and the protective padded portion 72. The vent opening 92 has a length with respect to the vertical cut 86 or vertical axis that is larger then the width of the vent opening 92 with respect to the lengthwise cut 78 or horizontal axis. A vent opening 94 is preferably disposed along the first angled cut 88 between the protective padded portion 70 and the protective padded portion 72. The vent opening 94 has a length greater than its width. The vent opening 94 is disposed at an angle differing from the lengthwise cut 78 or seam, the vertical cut 84 or seam, and the junction 84 or seam. Another vent opening 96 is preferably disposed along the second angled cut 90 between protective padded portions 66 and 68. The vent openings 92, 94, 96 are located along die cuts 86, 88 and 90, which do not correspond to joints of a user's hand and, therefore while there is some relative movement of the protective pads in which the vent openings are formed, the movement is not sufficient to cause a portion of a user's hand to be exposed. Further, unlike prior vent openings which were typically formed along horizontal cuts, which result in the back of a user's hand being exposed to contact as the glove flexed, the disclosed vent openings 92, 94, 96 are located along non-horizontal cuts and thus can be made larger as the potential for exposure is minimal. It should be understood that while three vent openings are disclosed on the rear portion 60 of the glove 10, any number of vent openings may be utilized. Additionally, the vent openings may be disposed in a variety of other locations along the rear portion 60 in accordance with the preferred embodiment, including within the respective individual padded portions themselves, instead of along the die cuts.

The finger portions 20 each have a respective padded portion 98 that extends from the second lengthwise cut 84 to the respective tip of each finger portion 100. As with the hand portion 18, each of the padded portions is disposed on an inner fabric layer 64 that overlies each of the finger portions 20. The hand portion 18 of the glove 10 has a first side portion 102 connecting the side 80 of the hand portion 18 to the palm portion 62. The other side 82 of the hand portion 18 has a side portion 104 which extends between the hand portion 18 and a thumb portion 22. The thumb portion 22 is in turn connected to the palm portion 62 on its other side.

The first side 102 of the glove preferably has a mesh layer 106 extending between one side 80 of the hand portion 18 and the palm portion 62 with a protective padded portion 108 secured thereon. The second side 104 of the glove also has a protected padded portion that is sub-divided into a first padded portion 110 and a second padded portion 112 by a vertical die cut 114 formed therein. A side vent opening 116 is preferably formed along the vertical cut 14 between the first padded portion 110 and the second padded portion 112 of the second side 104 of the glove 10. The thumb portion 22 has a plurality of protected padded portions formed thereon. The thumb portion 22 has a first padded portion 120 disposed adjacent a second padded portion 122 and separated by a horizontal cut 124. The second padded portion 122 is disposed adjacent a third padded portion, which is sub-divided into a first part 126 and a second part 128 by a vertical cut 130. A second horizontal cut 132 is disposed between the second padded portion 122 and the first and second parts of the third padded portion 126, 128.

Figure 4:
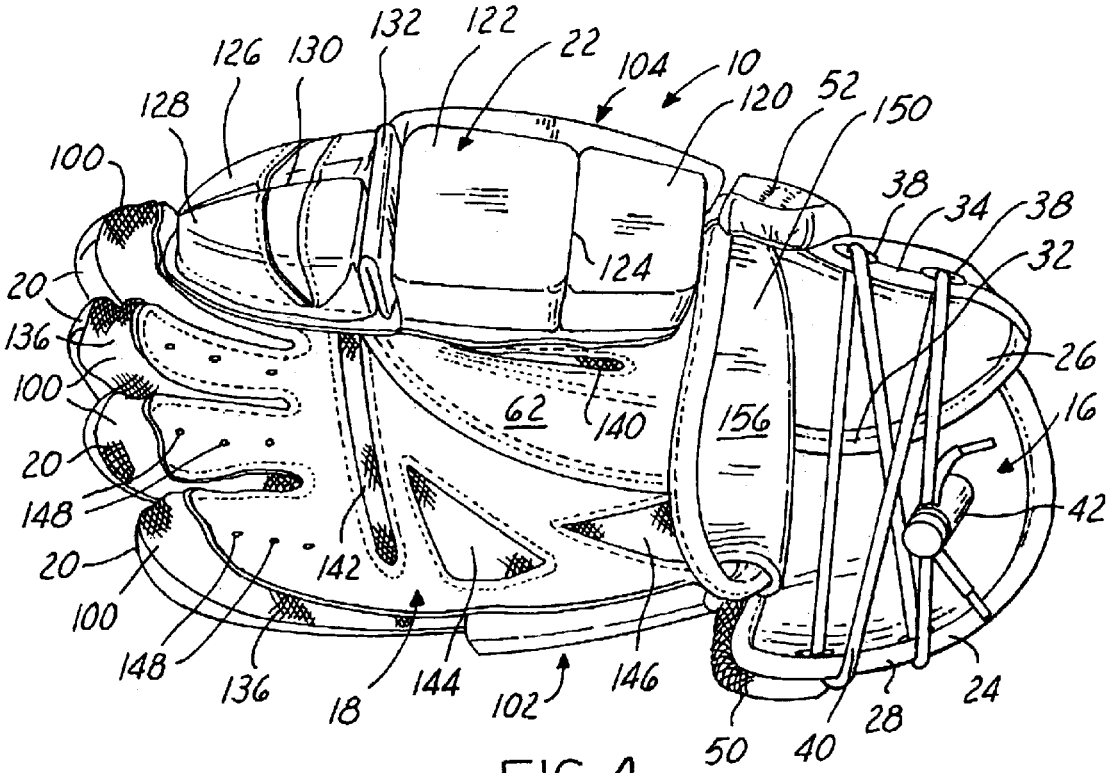
FIG. 4 is a bottom view of a protective sports glove in accordance with a preferred embodiment of the present invention.
Figure 5:
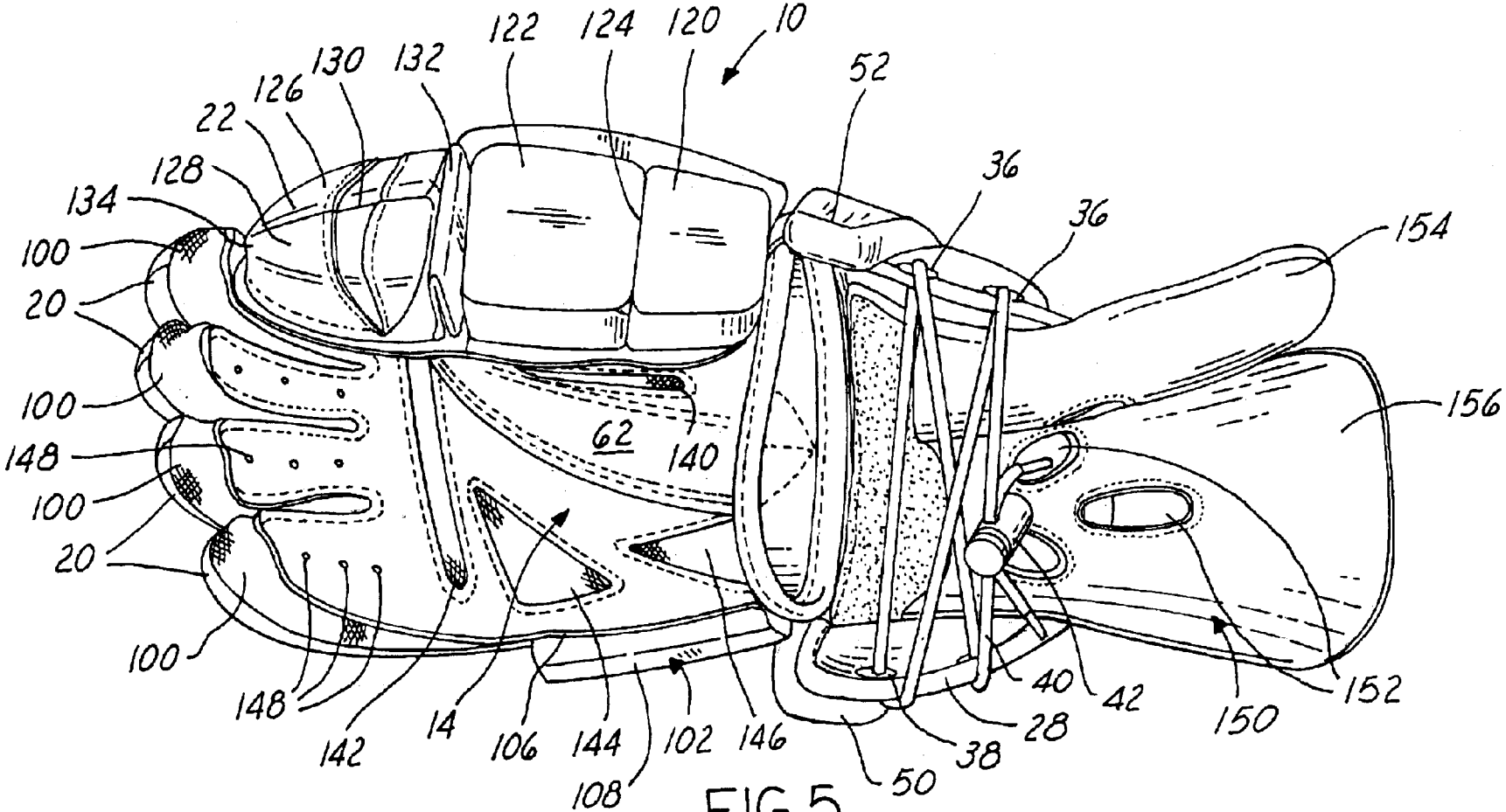
FIG. 5 is a bottom view of a protective sports glove illustrating the inner flap portion in accordance with a preferred embodiment of the present invention.

Referring now to FIGS. 4 and 5, which illustrate the palm portion 62 of the lacrosse glove, in more detail. The palm portion 62 extends from the lower edge of the hand portion 18 adjacent the seam 46 to the tips 100 of the finger portions 20 and the tip 134 of the thumb portion 22. The palm portion 62 is attached to each of the respective padded portions 98 of each finger portion 20 by a mesh layer 136. The mesh layer 136 allows for flexibility of the fingers within the finger portions 20 as well as to provide sufficient ventilation through the mesh layer 136 to a user's fingers. As shown, the palm portion 62 is preferably comprised of a durable material such as leather, a synthetic material, or any other known suitable material, generally illustrated by reference number 138. Mesh portions 140, 142, 144, and 146 are preferably located throughout the palm portion 62 to provide ventilation to a user's palm. The mesh portions are located in the palm portion 62 in areas that are not intended as primary contact areas for a stick. This is contrary to prior gloves that provide much larger mesh portions on the palm portion with mesh, which tend to wear and rip and thus render the glove illegal.

The first mesh portion 140 is preferably located at the junction between the palm portion 62 and the thumb portion 20. The first mesh portion 140 allows the thumb portion 20 to move with respect to the palm portion 62 without causing the palm material to bunch or bulge as typically occurs if the entire palm portion is formed of a wear-resistant material. Additionally, the second mesh portion 142 is disposed on the palm portion 62 at the junction between the hand portion 18 and the finger portions 20 to allow relative movement therebetween and to prevent bunching up of material at that joint as would typically occur if that portion were comprised of a wear-resistant material. Each of the finger portions 20 has a plurality of finger vent holes 148 formed in the durable wear-resistant material to provide ventilation to the user's fingers. The finger vent holes 146 are preferably formed by punching and must be formed far enough apart to prevent the durable material from ripping or tearing. The third mesh portion 144 and the fourth mesh portion 146 are also disposed in areas that are not likely to wear due to contact with a stick. The mesh portions 144, 146 are also disposed in locations that allow the glove to flex and therefore prevent bunching. Further, all of the mesh portions 140, 142, 144, 146, provide ventilation to the user's palm. It should be understood that more or less mesh portions may be included and the locations shown are merely exemplary and may obviously vary.

Figure 7:
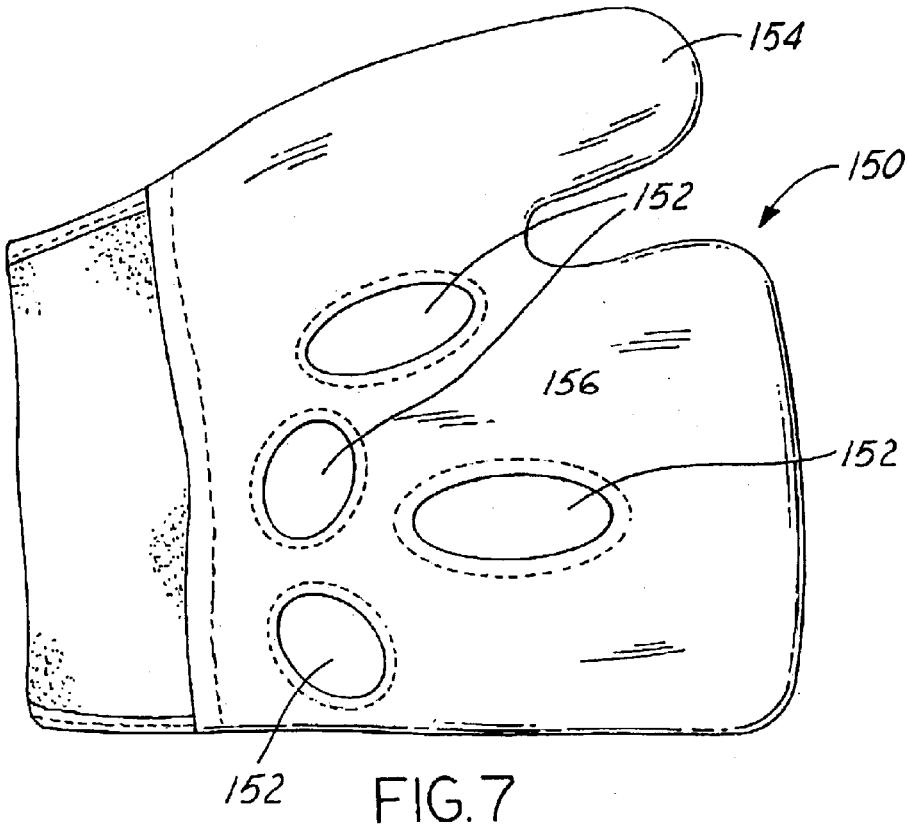
FIG. 7 is an illustration of the inner flap portion for a protective sports glove in accordance with a preferred embodiment of the present invention.

As shown in FIGS. 5 and 7, the glove 10 preferably has a flap portion 150 which is secured to the rear side of the cuff portion 16 and can move into and out of the interior portion of the glove. The flap portion 150 is shown in an inserted position inside the glove in FIG. 4 and is shown in a withdrawn position in FIG. 5. The flap portion 150 when in the inserted position, is designed to provide a better fit for the user's hand by taking up any excess space between the back of the user's hand and the underside of the hand portion 18. The flap portion 150 has a plurality of openings 152 formed therein, which correspond to a respective vent opening formed in the rear portion 60 and the second side 104 of the glove 10. The flap portion is preferably comprised of a foam or padded material so as to further protect the back of a user's hand from contact with a stick. As the flap portion 150 spans the seam 46 in the inserted position, it also assists the wrist guard 48 in preventing the back of a user's forearm or wrist from being exposed to contact with a stick. The flap portion 150 has a thumb portion 154 which preferably extends into the thumb portion 22 of the glove 10 to help to provide a better fit in the thumb portion and a palm portion 156 that helps provide a better fit for the hand.

Having now fully described the invention, it will be apparent to one of ordinary skill in the art that many changes and modifications can be made thereto without departing from the spirit or scope of the invention as set forth herein.

What is claimed is:

1. A sports glove comprising:

a hand portion having a palm portion;

a back portion opposing said palm portion and comprising an upper portion, a lower portion, a first side and a second side;

a plurality of discrete independently moveable protective padded portions disposed on said back portion;

at least one finger portion secured to and extending from said upper portion;

a thumb portion secured to and extending from said hand portion, said thumb portion being padded;

a cuff portion elastically coupled to said lower portion;

wherein a horizontal axis is defined as extending between said first side and said second side of said back portion and is substantially parallel to said lower portion;

a first glove flex line having a first side and a second side and extending generally from said first side to said second side and being generally parallel to said horizontal axis, at least one of said plurality of discrete protective padded portions disposed on said first side of said first glove flex line and another of said plurality of discrete protective padded portions disposed on said second side of said first glove flex line such that said at least one of said plurality of discrete protective padded portions disposed on said first side of said first glove flex line can move with respect to said another of said plurality of discrete protective padded portions disposed on said second side of said first glove flex line as the glove flexes; and a second glove flex line having a first side and a second side is defined within said back portion at an angle differing from said horizontal axis, at least one of said discrete protective padded portions disposed on said first side of said second glove flex line and another of said plurality of discrete protective padded portions disposed on said second side of said second glove flex line such that said at least one of said plurality of discrete protective portions disposed on said first side of said second glove flex line can move with respect to said another of said plurality of discrete protective padded portions disposed on said second side of said second glove flex line as the glove flexes.

2. The sports glove of claim 1, wherein a length of said second glove flex line includes a range from a full length of said back portion to a length of said back portion sufficient to facilitate flexing of a hand within the sports glove.

3. The sports glove of claim 1, wherein said second glove flex line is defined on said back portion extending between said upper portion and said lower portion such that said second glove flex line is defined by an angle perpendicular to said horizontal axis.

4. The sports glove of claim 3, wherein a vent is defined within said back portion lengthwise along said second glove flex line.

5. The sports glove of claim 1, wherein said thumb portion defines a third flex line between at least two protective pads on said thumb portion such that said third flex line extends along at least a portion of a length of said thumb portion.

6. The sports glove of claim 1, wherein a vent is defined within said back portion generally lengthwise along said second glove flex line.

7. The sports glove of claim 1, wherein said second glove flex line is defined on said back portion equidistant from said first side and said second side, said second glove flex line being generally perpendicular to said horizontal axis.

8. The sports glove of claim 1, wherein a vertical axis is defined between said upper portion and said lower portion perpendicular to said horizontal axis and centrally located on said back portion, wherein said second glove flex line extends along said vertical axis.

9. The sports glove of claim 1, wherein said second glove flex line is oriented diagonally with respect to said horizontal axis.

10. The sports glove of claim 9, further comprising:

at least one vent opening formed along said second glove flex line.

11. A sports glove comprising:

a hand portion having a palm portion;

a back portion opposing said hand portion and comprising an upper portion, a lower portion, a first side and a second side;

a thumb portion secured to and extending from said hand portion;

a wrist portion coupled to said lower portion; and at least one finger portion secured to and extending from said upper portion;

wherein a horizontal axis is defined as extending between said first side and said second side of said back portion substantially parallel to said lower portion;

wherein a vertical axis is defined between said upper portion and said lower portion perpendicular to said horizontal axis; and wherein a first vent is defined on said hand portion such that a length of said vent with respect to said vertical axis is greater than a width of said vent with respect to said horizontal axis.

12. The sports glove of claim 11, wherein a first seam is defined between two protective portions and equidistant from said first side and said second side.

13. The sports glove of claim 12, wherein a second seam is defined between said first protective portion and a third protective portion at an angle with respect to said horizontal axis.

14. The sports glove of claim 13, wherein a second vent is defined in said back portion lengthwise along said second seam.

15. The sports glove of claim 14, wherein a third seam is defined between said second protective portion and a fourth protective portion at an angle with respect to said horizontal axis.

16. The sports glove of claim 15, wherein a third vent is defined in said back portion lengthwise along said third seam.

17. The sports glove of claim 11, further comprising:

a plurality of vents defined within said back portion and having greater lengths than widths and disposed at angles differing from said horizontal.

18. A sports glove comprising:

a hand portion having a palm portion;

a back portion opposing said hand portion and comprising an upper portion, a lower portion, a first side and a second side;

at least one finger portion secured to and extending from said upper portion;

a wrist portion coupled to said lower portion; and a thumb portion comprising a proximal protective section located adjacent a base of said thumb portion and a distal protective section located adjacent a tip of said thumb portion, said proximal protective section coupled to said hand portion and said distal protective section extending from said proximal protective section;

wherein a thumb axis is defined extending from said proximal protective section to said distal protective section;

wherein a first flex line is defined on said thumb portion extending substantially parallel to said thumb axis.

19. The sports glove of claim 18, wherein said first flex line extends between at least two protective pads on said thumb portion such that said first flex line extends along a full length of said thumb portion.

20. The sports glove of claim 18, wherein said first flex line extends between at least two protective pads on said thumb portion such that said first flex line extends along a full length of said distal protective section.

21. The sports glove of claim 18, wherein said first flex line extends between at least two protective pads on said thumb portion such that said first flex line extends along a fraction of a full length of said distal protective section.

22. The sports glove of claim 18, wherein a vent is defined within said back portion lengthwise along said first glove flex line.

23. The sports glove of claim 18, further comprising:

a plurality of protective portions disposed on said thumb portion, wherein a plurality of flex lines are defined between members of said plurality of protective portions.

24. A sports glove comprising:

a hand portion having a palm portion;

a back portion opposing said hand portion and comprising an upper portion, a lower portion, a first side and a second side;

at least one finger portion secured to and extending from said upper portion;

a thumb portion secured to and extending from said hand portion; and a wrist portion coupled to said lower portion;

wherein a horizontal axis is defined extending between said first side and said second side of said back portion and is oriented substantially parallel to said upper portion;

wherein a first glove flex line is defined within said back portion extending diagonal with respect to said horizontal axis;

wherein a second glove flex line is defined within said back portion extending generally from said lower portion to said upper portion.

25. The sports glove of claim 24, wherein a length of said first glove flex line includes a range from a full length of said back portion to a length of said back portion sufficient to facilitate flexing of a hand within the sports glove.

26. The sports glove of claim 24, wherein a vent is defined within said back portion lengthwise along said second glove flex line.

27. The sports glove of claim 24, wherein said thumb portion defines a second flex line between at least two protective pads on said thumb portion such that said second flex line extends along a length of said thumb portion.

28. The sports glove of claim 24, wherein a vent is defined within said back portion lengthwise along said first glove flex line.

29. The sports glove of claim 24, wherein said second glove flex line is defined on said back portion equidistant from said first side and said second side.

30. The sports glove of claim 24, further comprising:

a plurality of protective portions disposed on said back portion, wherein a plurality of glove flex lines are defined between members of said plurality of protective portions.

31. A protective lacrosse glove comprising:

a cuff portion;

a hand portion coupled to said cuff portion, said hand portion having a palm portion and a back side portion having protective padding formed thereon and extending between a first side of said back side portion and a second side of said back side portion;

a plurality of finger portions extending from said hand portion;

wherein said palm portion includes a wear resistant material located in areas that are in high use and that are primarily intended to contact a lacrosse stick during play and at least one mesh portion that is located in an area that is not intended to primarily contact a lacrosse stick during play.

32. The sports glove of claim 31, further comprising:

a first flex line formed in said back portion that extends generally parallel to a horizontal axis that runs generally perpendicular to said first side and said second side.

33. The sports glove of claim 32, further comprising:

a second flex line formed in said back portion that extends generally parallel to a horizontal axis that runs generally parallel to said first side and said second side.

34. The sports glove of claim 33, wherein said second flex line is located generally equidistant between said first side and said second side.

35. The sports glove of claim 33, wherein said second flex line extends substantially from a lower portion of said hand portion to an upper portion of said hand portion.

36. The sports glove of claim 35, wherein said second flex line is generally planar.

37. The sports glove of claim 33, further comprising:

a vent opening formed along said second flex line.

38. The sports glove of claim 32, wherein said first flex line extends substantially from said first side to said second side of said hand portion.

39. The sports glove of claim 38, wherein said first flex line is generally planar.

40. The sports glove of claim 32, further comprising:

a vent opening formed along said first flex line.

41. The sports glove of claim 31, further comprising:

a third flex line that extends diagonally with respect to said first and second sides of said hand portion.

42. A sports glove comprising:

a hand portion having a palm portion;

a back portion opposing said hand portion and comprising an upper portion, a lower portion, a first side and a second side;

a plurality of discrete protective padded portions disposed on said back portion;

at least one finger portion secured to and extending from said upper portion at a junction;

a thumb portion secured to and extending from said hand portion;

a wrist portion coupled to said lower portion at a seam; and a first flex line having a first side and a second side formed in said back portion and extending substantially from said lower portion to said upper portion; said first flex line being located generally equidistant between said first side and said second side, such that at least one of said plurality of discrete protective padded portions is disposed on said first side of said first flex line and at least one other of said discrete protective padded portions is disposed on said second side of said first flex line to allow said protective padded portions located on opposing sides of said first flex line to move with respect to one another as the glove flexes about said flex line.

43. The sports glove of claim 42, further comprising:

a vent opening formed along said first flex line.

44. The sports glove of claim 42, further comprising:

a second flex line formed in said back portion and extending at an angle with respect to said first flex line.

45. The sports glove of claim 44, wherein said second flex line extends generally between said first side and said second side.

46. The sports glove of claim 45, wherein said second flex line extends generally parallel to a horizontal axis defined by said lower portion of said back portion.

47. A sports glove comprising:

a hand portion having a palm portion and a back side portion having protective padding formed thereon and extending between a first side and a second side of said back side portion;

a plurality of finger portions coupled to said hand portion at a junction;

a cuff portion coupled to said hand portion at a seam;

a horizontal axis defined by a line generally parallel said lower portion of said hand portion; and a plurality of seams extending substantially from said junction to said seam, said plurality of seams extending at an angle with respect to said horizontal axis, said plurality of seams having at least one individual discrete padded portion located on either side of each of said plurality of seams;

whereby said discrete padded portions located on opposing sides of each of said plurality of seams are moveable with respect to one another as the glove flexes about each of said plurality of seams.

48. The sports glove of claim 47, further comprising:

at least one vent opening formed on at least one of said plurality of seams.

49. The sports glove of claim 47, wherein at least one of said plurality of seams extends generally perpendicularly to said horizontal axis.

50. The sports glove of claim 47, further comprising:

at least one flex line extending generally from sold first side to said second side of said back portion.

51. A sports glove comprising:

a hand portion coupled to a said cuff portion, said hand portion having a palm portion and a back side portion having a plurality of discrete protective pads formed thereon and extending between a first side and a second side of said back side portion;

a plurality of finger portions extending from an upper portion of said hand portion at a junction;

a cuff portion extending from a lower portion of said hand portion;

a vertical axis that runs substantially perpendicular to said lower portion and said upper portion;

at least one flex line having a first side and a second side formed in said back portion that is disposed generally equidistant between said first side and said second side and runs substantially parallel to said vertical axis at least one of said plurality of discrete protective pads located on said first side of said at least one flex line and another of said plurality of discrete protective pads located on said second side of said at least one flex line such that said pads on either side of said at least one flex line can move with respect to one another as the glove flexes therealong; and at least one seam formed in said back portion at an angle with respect to said at least one flex line to allow pads located on either side of said at least one seam to move with respect to one another.

52. The sports glove of claim 51, wherein said first flex line extends substantially from said lower portion to said upper portion.

53. The sports glove of claim 51, further comprising:

at least one vent opening formed in said back portion.

54. The sports glove of claim 51, further comprising:

at least one vent opening formed along said first flex line.

55. The sports glove of claim 51, wherein said at least one seam is disposed at an angle with respect to said vertical axis.

56. The sports glove of claim 51, wherein said at least one seam extends generally from said first side to said second side.

57. The sports glove of claim 56, wherein said at least one seam extends generally perpendicular to said vertical axis.

58. The sports glove of claim 51, wherein said at least one seam has a vent opening formed therealong.

* * * * *